US005470185A

United States Patent [19]

Tsubota et al.

[11] Patent Number: 5,470,185

[45] Date of Patent: Nov. 28, 1995

[54] PARKING GARAGE

[75] Inventors: Takahiro Tsubota, 7-8-5, Nakayama-Sakuradai, Takarazuka, Hyogo; Hiroshi Kitajima, 1-10-8, Seihuuso, Toyonaka, Osaka, both of Japan

[73] Assignees: Takenaka Corporation, Osaka; Takahiro Tsubota, Hyogo; Hiroshi Kitajima, Osaka, all of Japan

[21] Appl. No.: 396,059

[22] Filed: Mar. 1, 1995

Related U.S. Application Data

[63] Continuation of Ser. No. 83,901, Jun. 28, 1993, abandoned.

[30] Foreign Application Priority Data

Jun. 30, 1992 [JP] Japan ..... 4-197692

[51] Int. Cl.[6] ..... E04H 6/34

[52] U.S. Cl. ..... 414/264; 414/245; 414/232; 414/228; 414/227; 52/174

[58] Field of Search ..... 414/227, 228, 414/231, 232, 233, 234, 235, 239, 240, 241, 242, 243, 244, 245, 246, 247, 248, 251, 252, 253, 257, 259, 261, 262, 264; 52/174; 364/478

[56] References Cited

U.S. PATENT DOCUMENTS

| | | | |
|---|---|---|---|
| 1,969,002 | 8/1934 | Gleichman . | |
| 2,746,616 | 5/1956 | Sinclair | 414/257 |
| 3,104,019 | 9/1963 | Duff | 414/232 |
| 3,136,431 | 6/1964 | Colbert | 414/248 |
| 4,322,804 | 3/1982 | Evans | 414/232 X |
| 4,543,027 | 9/1985 | Jones | 414/234 X |
| 5,083,891 | 1/1992 | Takahiro | 414/264 X |
| 5,083,891 | 1/1992 | Takahiro . | |
| 5,203,660 | 4/1993 | Takahiro . | |

FOREIGN PATENT DOCUMENTS

| | | | |
|---|---|---|---|
| 243692 | 11/1965 | Austria . | |
| 0380711 | 8/1990 | European Pat. Off. . | |
| 0504750 | 9/1992 | European Pat. Off. . | |
| 1430244 | 1/1966 | France . | |
| 1585920 | 2/1970 | France . | |
| 2646194 | 5/1990 | France | 414/264 |
| 144478 | 6/1990 | Japan | 414/264 |
| 818150 | 8/1959 | United Kingdom . | |

*Primary Examiner*—Frank E. Werner
*Attorney, Agent, or Firm*—Nikaido, Marmelstein, Murray & Oram

[57] ABSTRACT

A parking garage in which parking zones are arranged at both sides of a self-running lane, and slat conveyers are arranged at the lane and the parking zones, such that a vehicle that has run on the lane is conveyed to one of the parking zones by the slat conveyers. At exit, a vehicle in one of the parking zones is conveyed to the self-running lane by the slat conveyers, and it runs by itself on the lane to exit the garage.

17 Claims, 13 Drawing Sheets

FIG.16
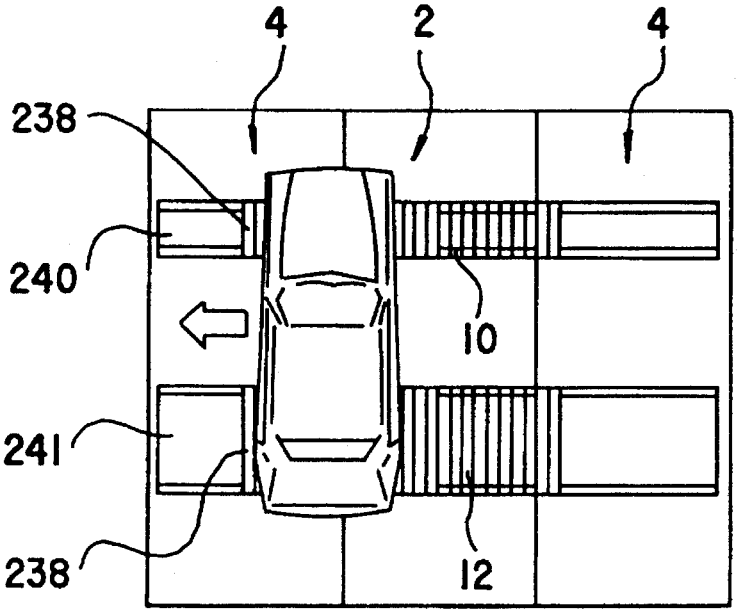
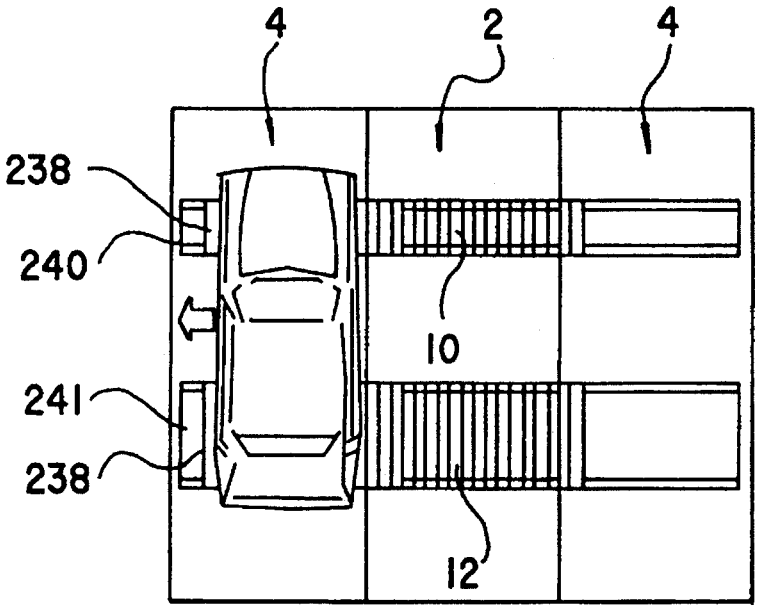
FIG.17

PARKING GARAGE

This application is a continuation of application Ser. No. 08/083,901 filed Jun. 28, 1993, now abandoned.

BACKGROUND OF THE INVENTION

1. Field of the Invention

The present invention relates to a parking garage and more particularly to a parking garage with simple structure and easy operation and moreover with high efficiency of parking capacity.

2. Description of Prior Art

In the prior art, one of the present inventors disclosed a parking garage wherein its entrance/exit floor and parking floor were connected through an entrance lift and an exit lift, and a carrier and parking pallets were arranged on the parking floor, thereby cars were conveyed by the carrier and parked on the pallets (U.S. Pat. No. 5,203,660). Further disclosed was a method to apply this three-dimensional parking garage to an underground one (U.S. Pat. No. 5,088,314). The concept of these parking garages was based on the assumption that these parking garages were unattended and fully automatic, no one could enter their parking floor, and cars were conveyed by lifts and carriers.

The present inventors made efforts to devise an innovative parking garage, different from these conventional ones, and with simple structure and easy operatibity. For instance, in the abovementioned patents, cars could not run by themselves in the parking floor. Also, the carriers employed in the above patents are expensive, and require a precise central control system by computer so as to stop cars at predetermined positions. To avoid these problems associated with the prior art, it has been found that a manual individual control system by users will realize a simple structure of parking garage with high parking capacity.

SUMMARY OF THE INVENTION

Accordingly, it is a general object of the present invention to provide a parking garage with simple structure and easy operation and high parking efficiency, in order to dispense with a carrier. It is a more specific object of the invention to make the motor of the feeder unit smaller and to prevent people from being sandwiched between cars being conveyed by feed unit and a wall. It is another object of the invention to reduce the number of slats in the slat conveyer of the feeder unit. It is still another object of the invention to change the length of an individual parking zone according to the kinds of cars, thereby to improve the efficiency of car parking. It is a further object to prevent possible car accident at entrance and exit. It is a still further object to provide a individual manual control of entrance and exit in each individual parking zone. It is another object of the invention to leave enough room between cars in a self-running lane and thereby to improve safety. A further object of the invention is to employ a slat conveyer and belt conveyer to feeder unit of self-running lane thereby to keep the feeder unit from disrupting self running of a car.

In a parking garage under the present invention, a feeder unit is arranged for self-running lane, thereby no carrier is required. For example, employment of a slat conveyer and belt conveyer to feeder unit of self-running lane will enable cars to run freely on self-running lane. The width of self-running lane must be of sufficient width for cars to run on. Major equipment in the parking garage is a feeder unit between parking zone and self-running lane, and it consists merely of slat conveyer and belt conveyer or rollers. And the control method of the parking garage is in principle a manual individual control in each individual parking zone.

To drive the feeder unit, a drive motor is arranged at a self-running lane and parking zone respectively. These motors may be low-powered, especially the motor at the parking zone. Using a high-speed high-powered motor would cause large inertia on the feeder unit itself and also cars to be conveyed by it. Large inertia would cause a collision between cars on conveyer. Therefore, a high-powered motor would require a reducing mechanism such as a breaker, especially one with fast-braking performance. Such a fast-braking breaker would cost far higher than a motor itself. Consequently, the use of a low-powered motor makes a breaker unnecessary and includes only a simple variable speed mechanism such as an inverter, making the feeder unit mechanism very simple. At entrance, the inertia given to a car by the feeder unit of the self-running lane moves the car into the parking zone. At this moment, the feeder unit at parking zone is made idle. Then, since there is nothing but inertia on parking zone, the possible danger of a person being sandwiched between cars and a wall in a parking zone is minimized. At exit, the role of sub motor is only to make a car contact to the feeder unit of self-running lane. Accordingly, low-powered motors are sufficient for the purpose of driving feeder units, in addition, they dispense with a breaker.

A slat conveyer, with preferable antiweatherability and flat surface, is suitable for feeder unit. The cost of a slat conveyer is slightly higher than that of belt conveyer by the cost for its slats, but there is no difference in other mechanisms between a slat conveyer and a belt conveyer. Slats are not necessarily arranged all around the conveyer, for example, they may only be arranged partially in parking zone. In this case, the conveyer at parking zone does not turn around but turns only half. For this reason, the face appearing on the conveyer surface always appears there and its reverse face does not appear on surface. As a consequence, arranging slots only on the face appearing on the conveyer surface will reduce the number of slats by 50%. Tires of a car will actually be located only near the both ends of the conveyer. The location of tires are designated on the basis of the condition of a car parked. Therefore, slats should be arranged only near the both ends of the conveyer, and other portion of the conveyer may be covered so that a person should not fall into the inside of conveyer. There is no use making the length of parking zone constant. Setting up three different lengths, for example are for light cars (in Japanese standards), one for compact cars, and are for large ones will allow a preferrably intensive parking system according to the kinds of the length of cars.

Since the parking garage in accordance with the present invention is manually controlled by people within the parking garage, alarm lamps are arranged so as to reduce the likelihood of accidents. These alarm lamps are without warning sound, and they are made more effective by flickering than by mere illumination. When a newly arriving car runs into the self-running lane, all the alarm lamps flicker to give warning to all the users within the parking garage. On the other hand, when a car exits the garage, an individual alarm lamp flickers to give attention to the car following it. Instead of such a simple safety control, the distance between cars on self-running lane may be confirmed, thereby it may be arranged so that a car should not be taken out when the distance is short. Further, lifts may be arranged to the parking garage to make it three-dimensional, and one row, two or three rows of individual parking zone may be laid out on the both sides of lane, also partially plural rows individual parking zone may be laid out according to lot shape. In case to use rollers, it is preferable to use rollers only for the feeder unit of parking zone and use slat conveyer or belt conveyer for the feeder unit of self-running lane, thereby to help cars run freely.

In the following preferred embodiments, all the conveyers are controlled manually, but they may be controlled automatically by use of a central control panel, remote-controlled switches for infrared signal transmission per parking zone.

Other objects and advantages of the present invention will become apparent from the detailed description to follow taken in conjunction with the appended claims.

BRIEF DESCRIPTION OF THE DRAWINGS

In the accompanying drawings, there are shown illustrative embodiments of the invention from which these and other of its objectives, novel features, and advantages will be readily apparent.

In the drawings:

FIG. 16 is a floor plan to show the starting status of a car being conveyed from self-running lane to parking zone in another preferred embodiment.

FIG. 17 is a floor plan to show the moving status of a car in parking zone in another preferred embodiment.

DESCRIPTION OF THE PREFERRED EMBODIMENT

The invention is illustrated in more detail by reference to the following referential examples and preferred embodiments wherein.

EXAMPLE 1

The first preferred embodiment of the present invention is illustrated in FIGS. 1 to 4. This embodiment shows a parking garage for large commercial vehicles such as buses, construction machines, and so on, but it may be a temporary parking garage for cars in a gas station and the like, or a private parking garage for cars in an office building.

Figure 1:
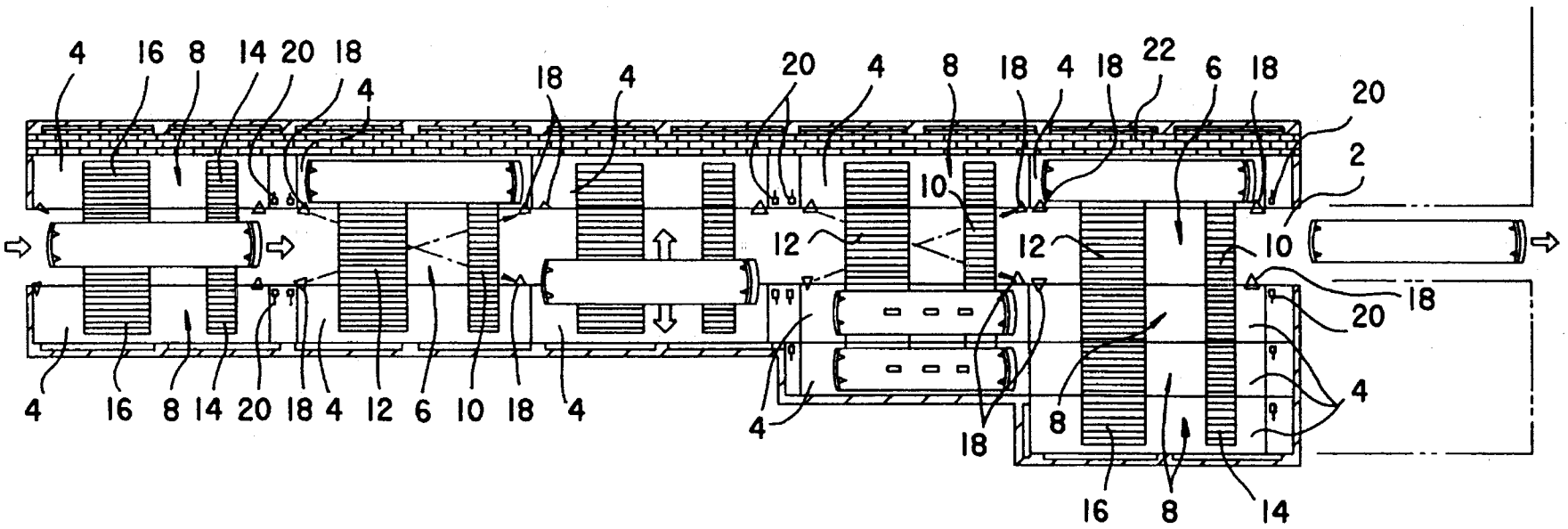
FIG. 1 is a floor plan of the bus parking garage of the first preferred embodiment.

Referring to FIG. 1, 2 is a self-running lane, while 4 is an individual parking zone arranged at the both sides of the self-running lane. The individual parking zone may be laid out in two or three rows as shown in FIG. 1. This is because it is hard to obtain a large-size site for large vehicles such as buses, so the number of parking cars is increased by laying out two or three rows of individual parking zone.

6 is a crossfeeder unit arranged at the self-running lane 2, while 8 is a crossfeeder unit arranged at the individual parking zone 4. The crossfeeder unit 6 is equipped with two slat conveyers, i.e, a slat conveyer 10 for front wheels and a slat conveyer 12 for rear wheels. The crossfeeder unit 6 may be equipped with belt conveyers in place of slat conveyers. And the crossfeeder unit 8 arranged at the individual parking zone 4 is equipped with, for example, rollers for front wheels 14 and rollers for rear wheels 16. 18 shows a safety sensor arranged on the self-running lane 2, and for example, an ultrasonic sensor may be employed for determining if there is a car on the self-running lane 2. 20 is a control lever to operate the crossfeeder units 6 and 8. 22 identifies a passenger lane.

Figure 2:
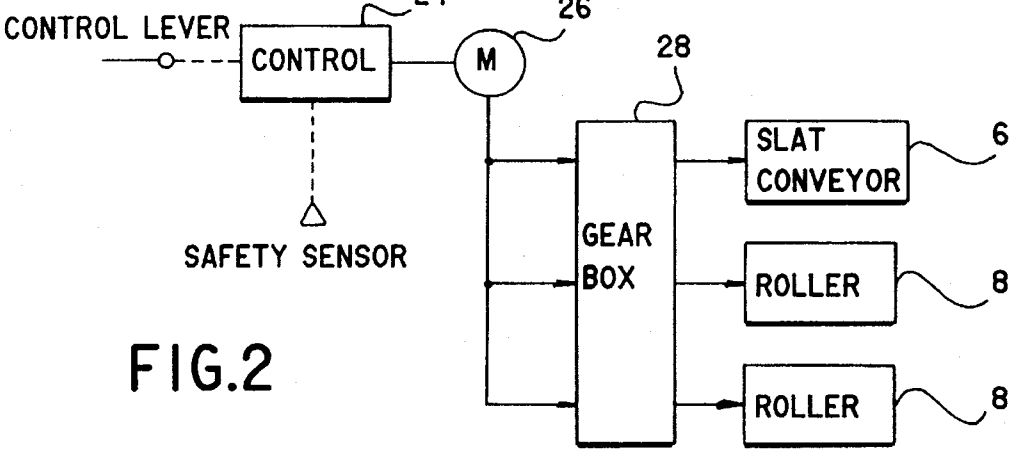
FIG. 2 is a control block diagram of the feeder unit of the bus parking garage of the first preferred embodiment.

FIG. 2 shows a control circuit of the crossfeeder units 6 and 8, wherein 24 is a control circuit, 26 is a motor to be arranged to each crossfeeder unit 6 of the self-running lane 2, and 28 is a gear box to transmit the power of the motor 26 to the crossfeeder units 6 and 8.

Figure 3:
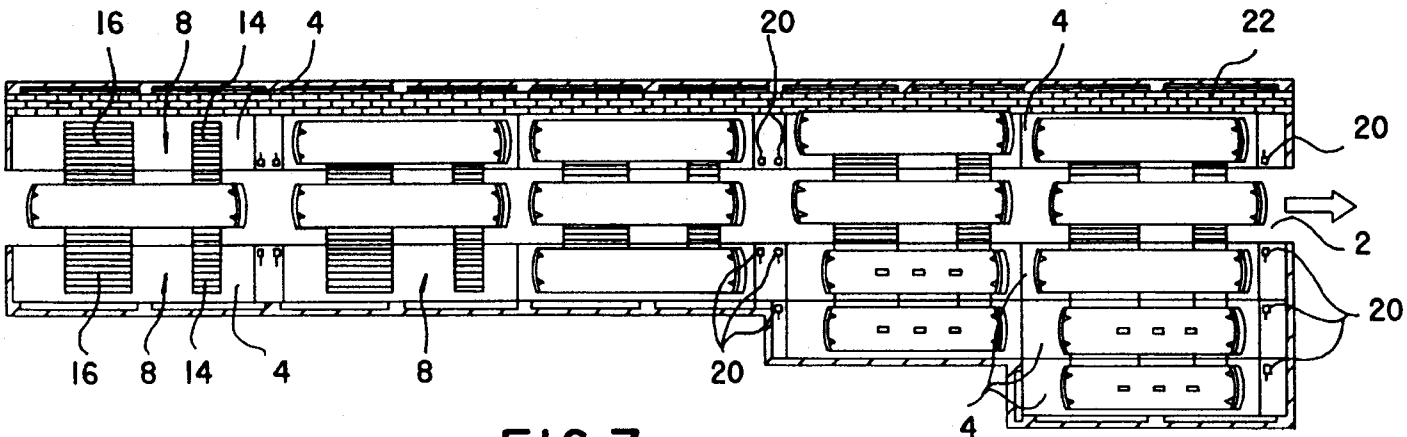
FIG. 3 is a floor plan to show the service condition at slack time zone of the bus parking garage of the first preferred embodiment.

FIG. 3 shows a parking condition of bus garage at a slack period such as midnight or noon. In such a bus garage, since the order of buses exiting is predetermined by time schedule or the like, it is feasible to increase the parking capacity by parking buses even on the self-running lane 2.

Figure 4:
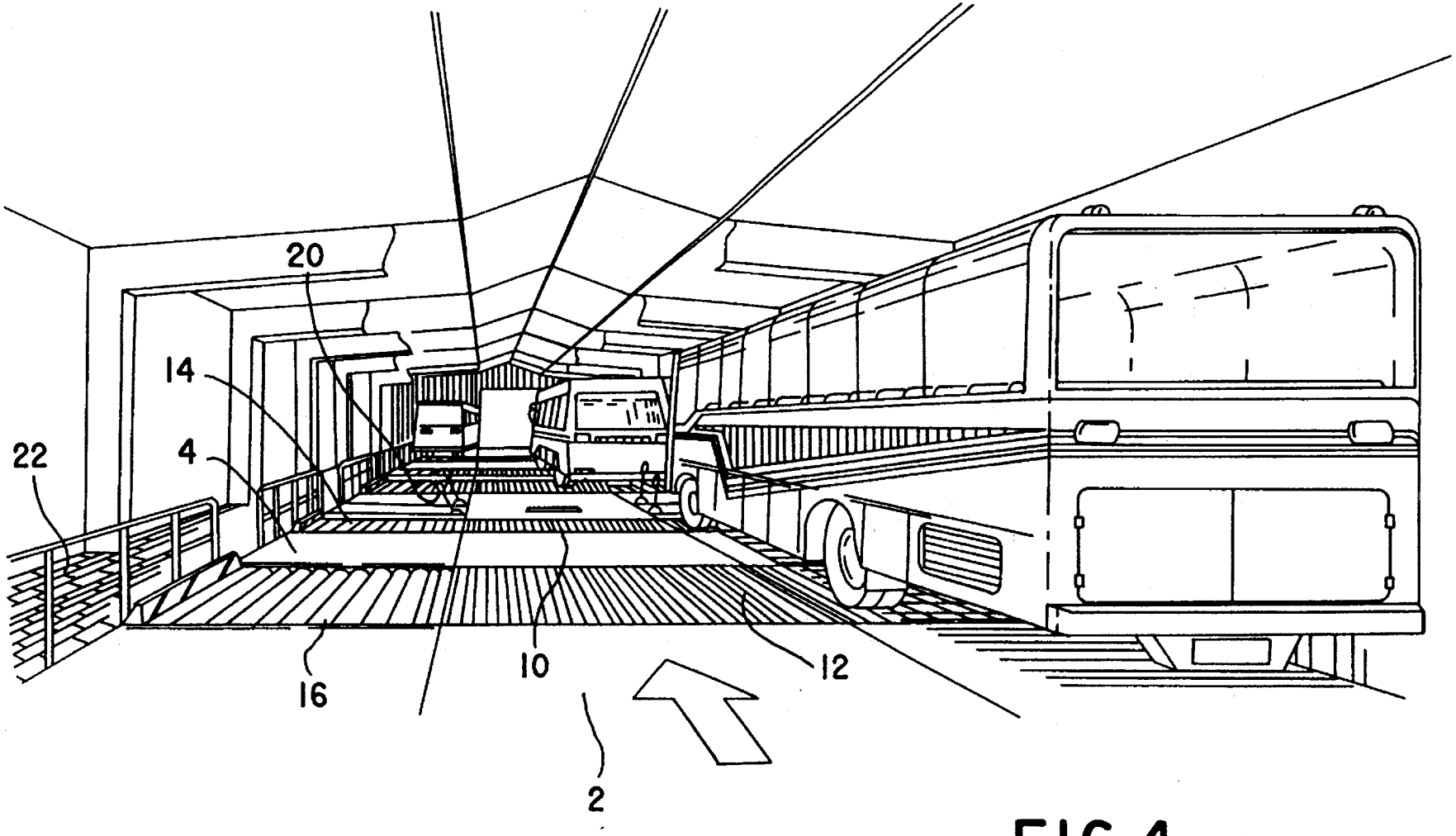
FIG. 4 is a perspective view to show the service condition of the bus parking garage of the first preferred embodiment.

FIG. 4 shows a perspective view of the first preferred embodiment under the present invention. In reference with this figure, the actions of this embodiment are explained hereinafter. The self-running lane 2 has an entrance and an exit, and a bus runs on the self-running lane 2 and stops at a desired position by the individual parking zone 4. A bus driver gets off the bus and manipulates the control lever 20 to operate the motor 26. The motor 26, for instance, is arranged under the self-running lane 2 for each crossfeeder unit 6, and transmits its power through the gear box 28 to the crossfeeder units 6 and 8. The control lever 20 is arranged at each individual parking zone, and has two actions, i.e., entrance and exit. Turning the control lever 20 to the entrance side causes the power of the motor 26 to be transmitted through the gear box 28 to the crossfeeder unit 6 and the crossfeeder unit 8 at the side where the control lever is manipulated. As shown in FIG. 1, in the case of two or three rows of the individual parking zone 4, for example, manipulating the control lever 20 at the deepest individual parking zone will cause all the crossfeeder units 6 and 8 from there to the self-running lane 2 to be activated. In this example of preferred embodiment of the present invention, whether the crossfeeder units 6 and 8 should be operated toward the direction of entrance or that of exit depends on the control lever 20. As a consequence, a bus parking on the self-running lane 2 is conveyed to the individual parking zone 4 with its front wheels loaded on the crossfeeder unit 6 and its rear wheels loaded on the crossfeeder unit 8.

Those skilled in the art may want to arrange a powered carrier to the self-running lane 2, thereby to convey a bus onboard it. However, required for large vehicles such as buses or construction machines is a large-size and complicated powered carrier. On the other hand, drivers of buses are limited to those who are well skilled in driving a bus, and have no problem to drive a bus on the self-running lane 2, stop its front wheels on the slat conveyer 10 for front wheels and its rear wheels on the slat conveyer 12 for rear wheels. Next, in this embodiment of the present invention, the crossfeeder units 6 and 8 are manually operated through the control lever 20. This is because for a driver to stop his bus at a correct position then to operate the crossfeeder units 6 and 8 manually through the control lever 20 is safer than a computer-controlled operation of the crossfeeder units 6 and 8. Also it is easy for a driver who constantly uses this bus parking garage to operate the control lever 20.

In this embodiment, a slat conveyer was employed as the crossfeeder unit 6 of the self-running lane 2, and low-priced rollers were used as the crossfeeder unit of the individual parking zone 4. This is for the purpose of making the surface of the self-running lane 2 flat as shown in FIG. 4, thereby make car running easy.

The actions for exit are reverse to those for entrance mentioned above. Manipulating the control lever 20 of the individual parking zone 4 where the bus is will operate the crossfeeder units 6 and 8 to convey the bus to the self-running lane 2, then the bus is taken out of the garage. The self-running lane 2 has an exit and an entrance, so bus is conveyed out of the garage by moving it only forward without moving it backward. With this configuration, safety sensor should detect only buses coming from behind. In this configuration, there is no need for space to turn a bus 90 degrees since it runs freely from the self-running lane 2 to the individual parking zone 4, and as a result, the width of the self-running lane 2 may be only that necessary for a bus to run on, and the width of the individual parking zone 4 may be the minimum one corresponding to the width of bus since it is conveyed by the crossfeeder units 6 and 8. Consequently, the parking capacity of bus per site can be improved by over 50%. By the way, according to site shape, the individual parking zone 4 may be arranged partially at only one side of the self-running lane 2 instead of arranging the individual parking zones 4 at both sides along the self-running lane 2.

When a bus is about to advance behind another on the self-running lane 2, if the bus is moved from the individual parking zone 4 to the self-running lane 2, there may be a possibility of a collision. In this case, driver is absorbed in the crossfeeder of his bus, so he would be unaware of another bus approaching from behind. Also it is very hard for the driver of a bus running by itself on the self-running lane 2 to know which vehicle will be conveyed from its individual parking zone to the self-running lane 2. Therefore, a number of safety sensors 18 are arranged at the self-running lane 2 in order to detect buses running on the lane 2. And if there is, for example, another bus running within the range corresponding to the length of a few buses behind in line viewed from the individual parking zone 4 from which a concerned bus is about to be taken out, the control circuit 24 in FIG. 2 will make the exit action from the control lever 20 invalid. Namely, when a bus is being taken out from the individual parking zone 4, if there is another bus running within the distance corresponding to the length of a few buses behind in line, the crossfeeder units 6 and 8 will be disabled. As a result, there is a significantly reduced likelihood of bus collision. A driver who has got off his bus gets out of the garage through the passenger lane 22. The crossfeeder units 6 and 8 are operated through the control lever 20, and safety is confirmed by the safety sensors 18, therefore this embodiment will enable an automatic operation without an operator.

EXAMPLE 2

Figure 5:
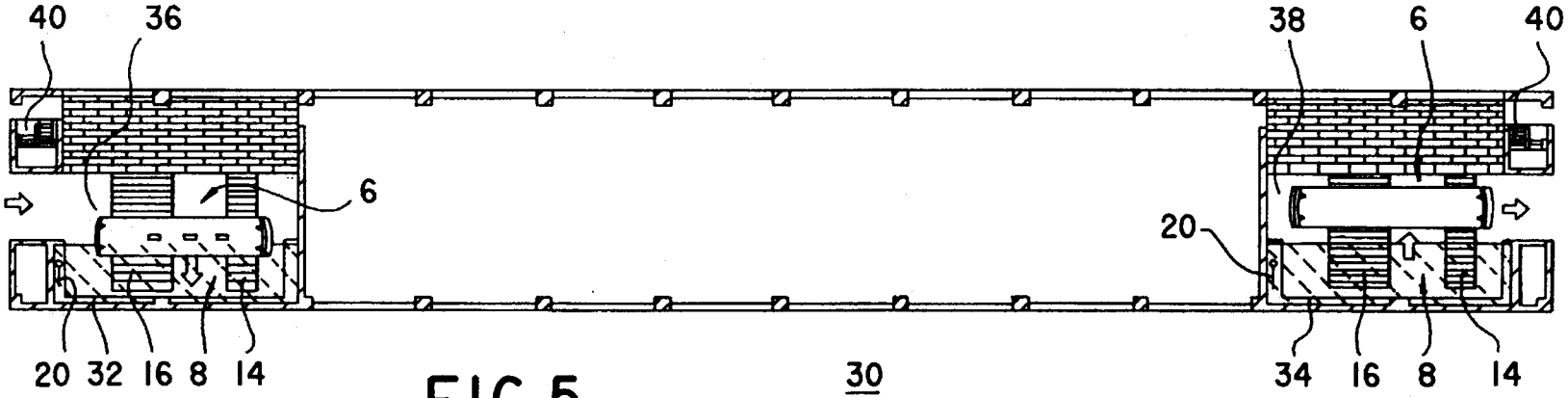
FIG. 5 is a major floor plan of the ground floor of the bus parking garage of the second preferred embodiment of the present invention.
Figure 6:
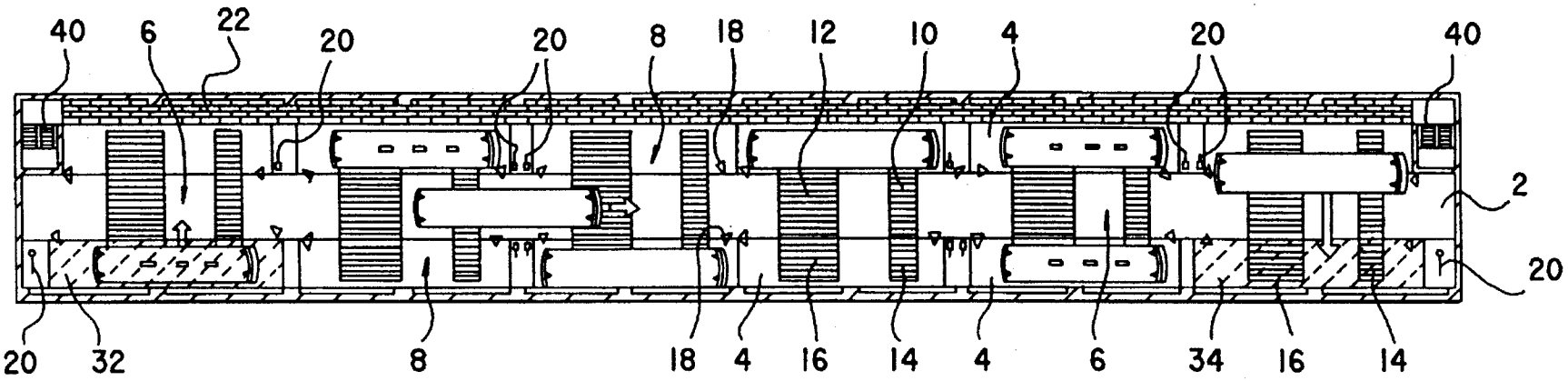
FIG. 6 is a major floor plan of the parking floor of the bus parking garage of the second preferred embodiment.
Figure 7:
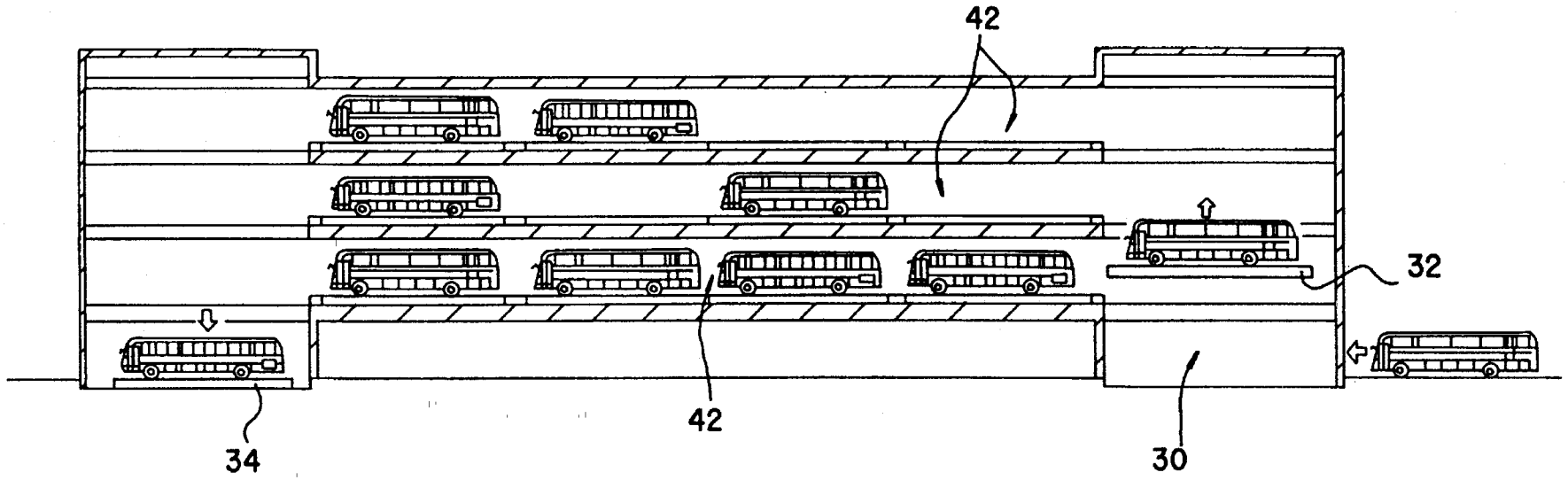
FIG. 7 is a major cross section diagram of the bus parking garage of the second preferred embodiment.

FIGS. 5 through 7 show the second preferred embodiment of the present invention wherein the first embodiment of FIGS. 1 through 4 is applied to a three-dimensional parking garage. In FIG. 5, 30 is a ground floor, 32 an entrance lift, 34 an exit lift, 36 an entrance berth, 38 an exit berth, and 40 shows a stairway to parking floors. To the berths 36 and 38, arranged is the crossfeeder unit 6 using slat conveyer. Crossfeeder unit 8 is configured with the lifts 32 and 34 using rollers or the like. The space between the entrance berth 36 and the exit berth 38 on the ground floor 30 may be utilized, for example, as an office, shop, or gas station.

FIG. 6 shows the structure of the parking floor. The parking floor 42 is the same as that of the first preferred embodiment illustrated in FIGS. 1 through 4, except for the arrangement of the entrance lift 32 and the exit lift 34. In this figure, a row of the individual parking zones 4 is laid out at each side along the self-running lane 2, however, as in FIG. 1, two or three rows of the individual parking zone 4 may be laid out at each side. FIG. 7 shows a cross section of a three-dimensional parking garage where three stories of the parking floor 42 are arranged. Parking floor 42 may be arranged underground.

Hereinafter explained are the actions of the second preferred embodiment. First, a bus that is in the entrance berth 36 stops on the crossfeeder unit 6. Its driver departs the bus and manipulates the control lever 20 to move the bus transversely to the entrance lift 32. Next, the driver operates the entrance lift 32 to convey the bus to the desired one of three parking floors 42. The driver goes to the desired one of the parking floors 42 through the stairway 40 and the like, and manipulates the control lever to move the bus transversely from the entrance lift 32 to the self-running lane 2. Then, the driver get in the bus and drives it on the self-running lane 2 and stops it at a position adjacent to the desired individual parking zone 4. The driver stops the bus on the crossfeeder unit 6, and to take out the bus, he makes the same actions as in the first preferred embodiment shown in FIGS. 1 through 4.

When exiting the driver moves the bus onto the crossfeeder unit 6 of the self-running lane 2, then gets in the bus to drives it to a position facing the exit lift 34. Next, he transfers the bus to the exit lift 34 by the crossfeeder units 6 and 8. After that, he lowers the bus to the ground floor 30 by the exit lift 34, and operates the crossfeeder units 6 and 8 again to move the bus to the exit berth 38. After that, he drives the bus to start through the exit berth.

In this embodiment of the present invention, the entrance lift 32 and the exit lift 34 are arranged separately, therefore, there is no need for bus to make a U-turn or to go backward within the parking garage, enabling entrance and exit of bus only by driving it forward. Also the berths 36 and 38 are arranged separately from the lifts 32 and 34, as a result, there is no need for a driver to drive his bus directly to the narrow exit lift 32. Also there is no need for him to start his bus directly from the narrow exit lift 34.

By the way, the second preferred embodiment has been explained heretofore with the application example of a bus parking garage for regular-route buses and the likes, however, this embodiment may be a parking garage for sight-seeing buses at a sight-seeing spot, or a temporary parking garage for cars in a gas station and the like, or a private parking garage for cars in an office building or the likes.

EXAMPLE 3

Figure 8:
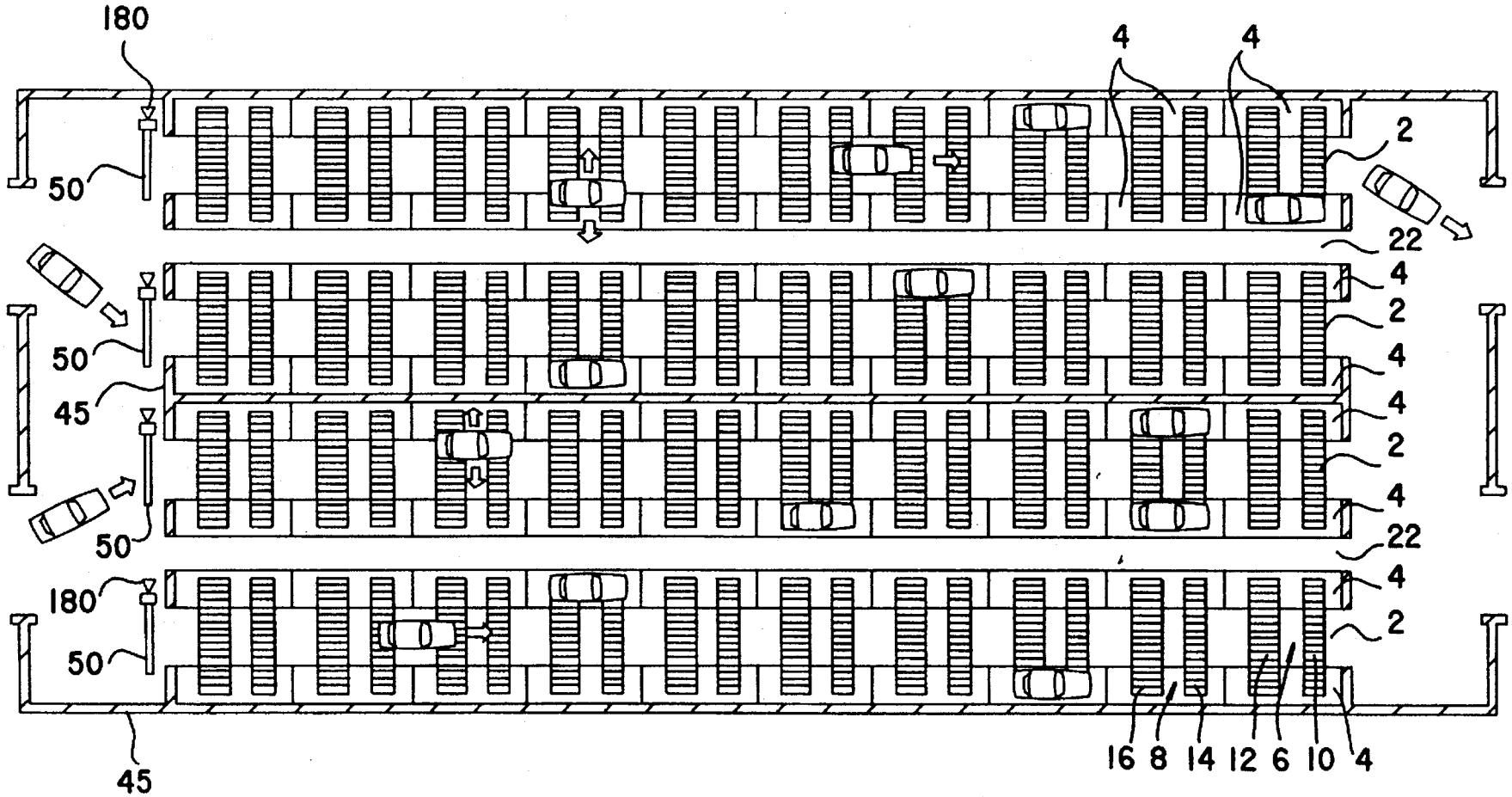
FIG. 8 is a floor plan of the parking garage for privately-owned cars of the third preferred embodiment.

FIGS. 8 through 12 shows the third preferred embodiment of the present invention wherein the first embodiment of FIGS. 1 through 4 is applied to a flat parking garage for passenger cars on a vacant land. In FIG. 8, arranged are four lines respectively comprising a self-running lane 2 and two individual parking zones 4 laid out on the both sides of the self-running lane. The line here means one consisting of a self-running lane 2 and a pair of individual parking zones 4 laid out on the both sides of the self-running lane, and how many lines to be arranged may be determined according to the size of site. In the figure, 45 is a boundary consisting of fence or concrete blocks, and may not be arranged. 50 is an entrance gate located at the entrance side of the self-running lane 2, and a safety sensor 180 is arranged at the entrance gate 50. The safety sensor 180 may be an ultrasonic sensor in order to detect a car going from the entrance gate 50 to the self-running lane 2.

Figure 9:
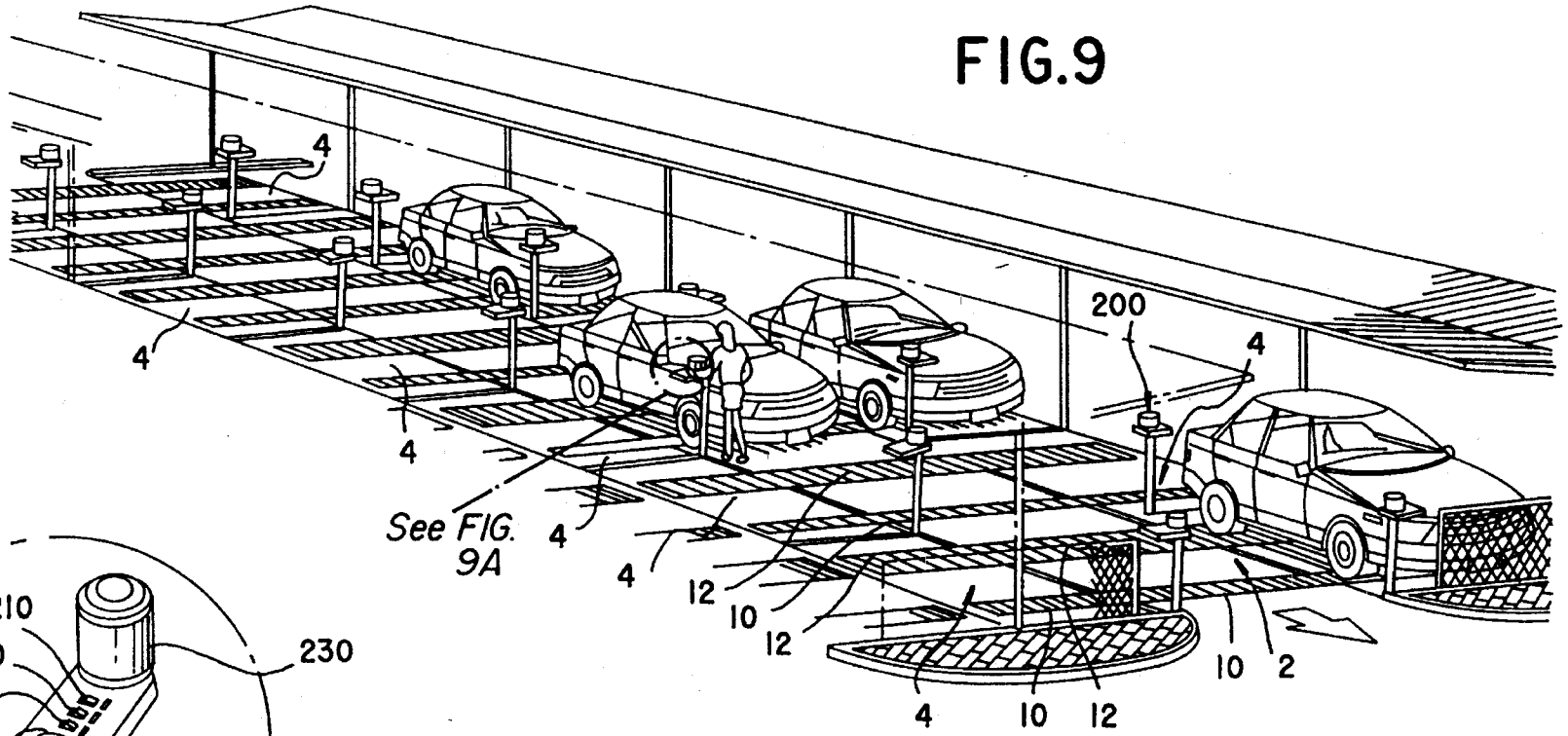
FIG. 9 is a perspective view to show the third preferred embodiment.
Figure 9A:
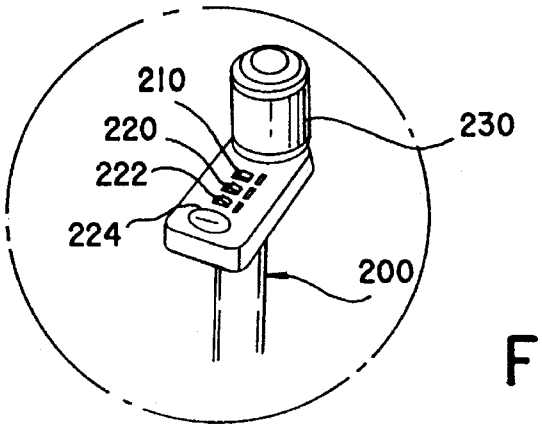

Referring to FIG. 9, 200 is a control panel arranged at each individual parking zone 4 to control the zone 4 and the crossfeeder units 6 and 8 of the self-running lane 2 adjacent to that zone 4, and this may be replaced with a control lever 20. The control panel 200 has an entrance switch 210 and an exit switch 220, a stop switch 222, a key switch 224, and an alarm lamp 230. The switches 210 and 220 are used to operate the crossfeeder unit 6 and 8, while the stop switch 222 is used to stop the crossfeeder units at emergency. The key switch 224 allows only a driver with key to operate the control panel 200. Turning on the entrance switch 210 will move a car transversely from the self-running lane 2 to the individual parking zone 4, while turning on the exit switch will move it transversely from the individual parking zone 4 to the self-running lane 2. To operate the control panel 200, for example, a driver may receive the concerned key in exchange for his parking charge and insert the key into the key switch 224. The alarm lamp 230 will flicker when the safety sensor 180 detects a car entering the self-running lane 2, and when the exit switch 220 is turned on.

Figure 10:
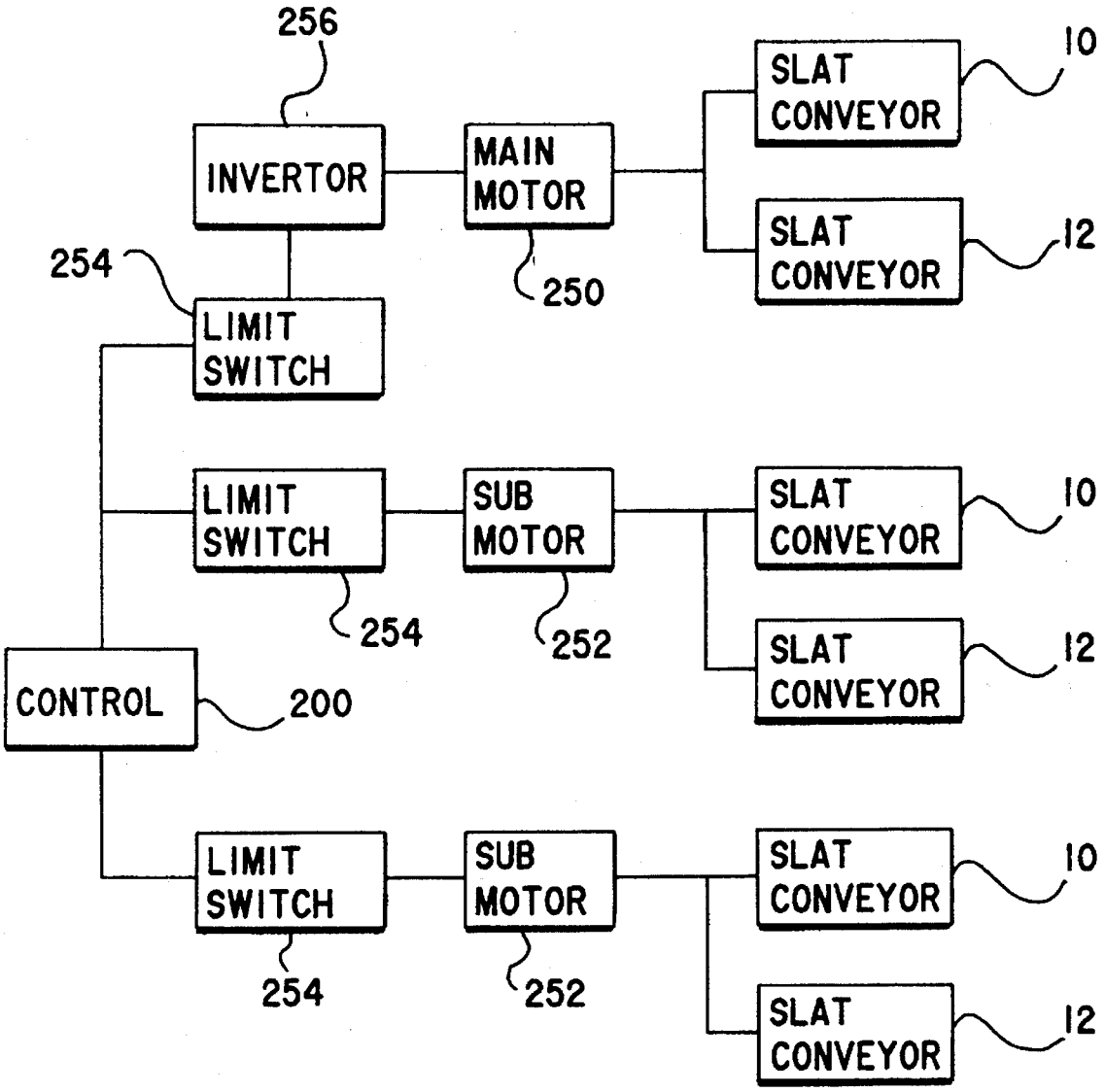
FIG. 10 is a block diagram to show the control system of the third preferred embodiment.

FIG. 10 shows the control system of the crossfeeder units 6 and 8. Drive motors 250 and 252 are arranged in the crossfeeder units 6 and 8 respectively, and the motor 252 of the crossfeeder unit 8 is a sub motor with a lower power than that of a main motor 250 of the crossfeeder unit 6. In order to make the main motor 250 a speed-variable one, it is driven by, for example, an inverter 256, and the sub motor 252 is not equipped with a breaker and the like. Also to control the stop of the motors 250 and 252, a limit switch 254 is connected to each of them.

Figure 11:
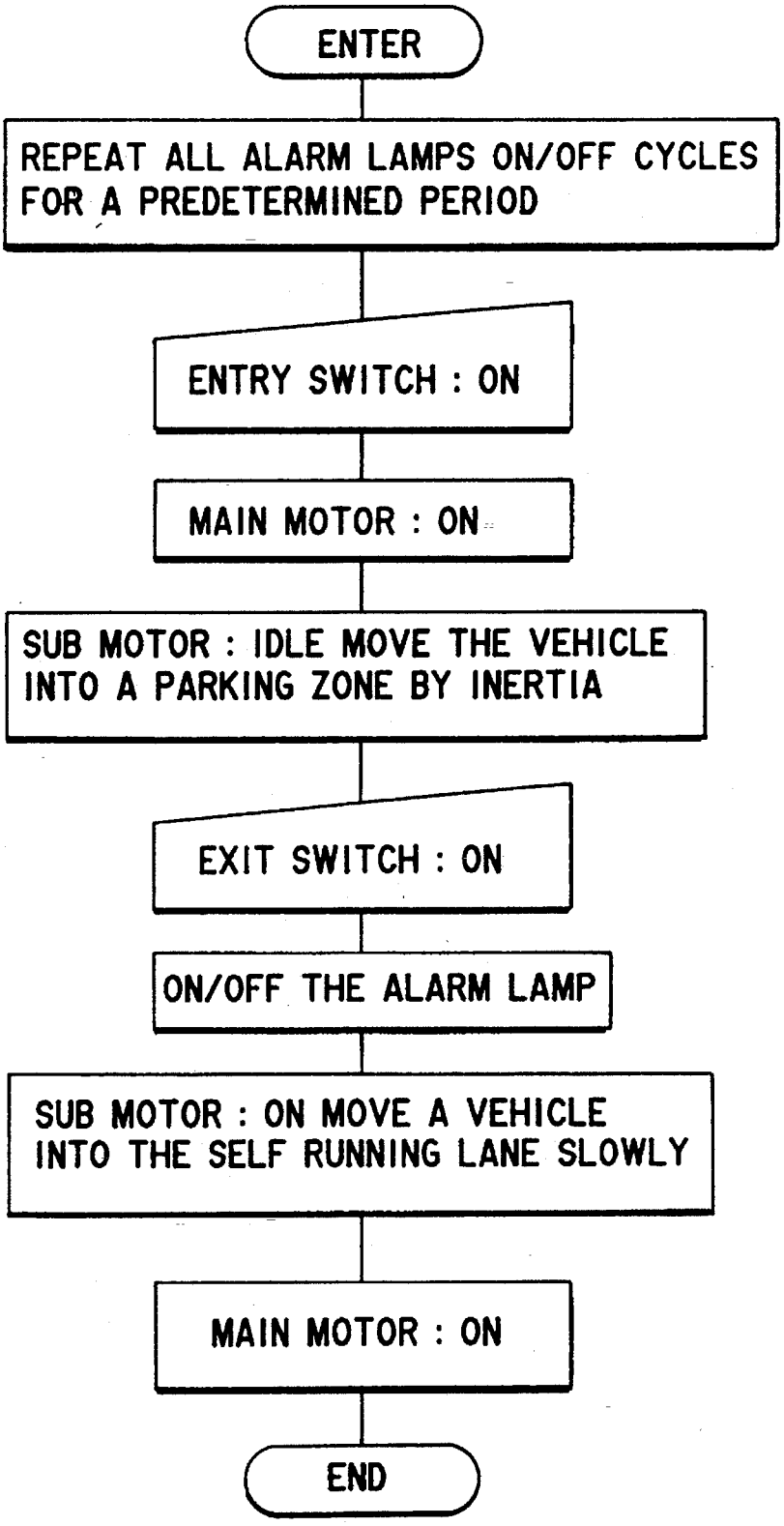
FIG. 11 is a flowchart to show the action sequence of the third preferred embodiment.

FIG. 11 shows the control algorithm of the crossfeeder units 6 and 8 and the alarm lamp 230. When a car passes the entrance gate 50, the safety sensor 189 detects it, and the alarm lamps 230 at all the individual parking zones 4 facing the self-running lane 2 flicker, thereby a warning is given to all the people within the self-running lane 2 and the parking zones 4 of its both sides. By the way, the use of the alarm lamps 230 is to avoid noisy sound of a buzzer or a speaker, and their flickering is to make a more effective warning than their merely illuminating. When a car approaches its desired parking zone 4, its driver inserts the key into the control panel 200, and presses the entrance switch 210 to operate the crossfeeder units 6 and 8. At this time, only the main motor 250 of the crossfeeder unit 6 operates, and the sub motor 252 is set to be idle. In this case, the main motor 250 operates at a constant speed, and when the crossfeeder unit 6 moves the car by the distance corresponding to the width of the self-running lane 2 (in the case of slat conveyer, when it turns halfway), the limit switch 254 stops the main motor 250. The car goes by inertia to the crossfeeder unit 8, and since the sub motor 252 and the crossfeeder unit 8 are both idle, the crossfeeder unit 8 runs idle and the car advances by inertia and stops within the parking zone 4. Since the crossfeeder unit 8 runs idle and the car moves by inertia, there is no fear of a person being sandwiched between a car and a bumping post or between cars already parked.

At the moment of exit, the exit switch 220 is turned on to cause only the concerned alarm lamps 230 at the zone 4 to flicker for a certain time. For this, a driver in car on the self-running can know from where an exiting car will come out on the lane 2. At exit, the sub motor 252 is activated to move a car to the crossfeeder unit 6 at a low speed. The crossfeeder unit 6 of the lane 2 is driven by the main motor 250 and conveys the car at a speed higher than that of the crossfeeder unit 6 of the zone 4. The role of the sub motor 252 is to move the tires of one side of a car to the crossfeeder unit 6 of the self-running lane 2, so it may be a low-powered motor without breaker or speed variable mechanism. The main motor 250 is controlled by the inverter 256 to speed down in the latter half of movement toward the self-running lane 2, thereby to remove inertia from the car. After then, the driver gets in the car and drives it on the self-running lane 2 to take it out of the garage.

Figure 12:
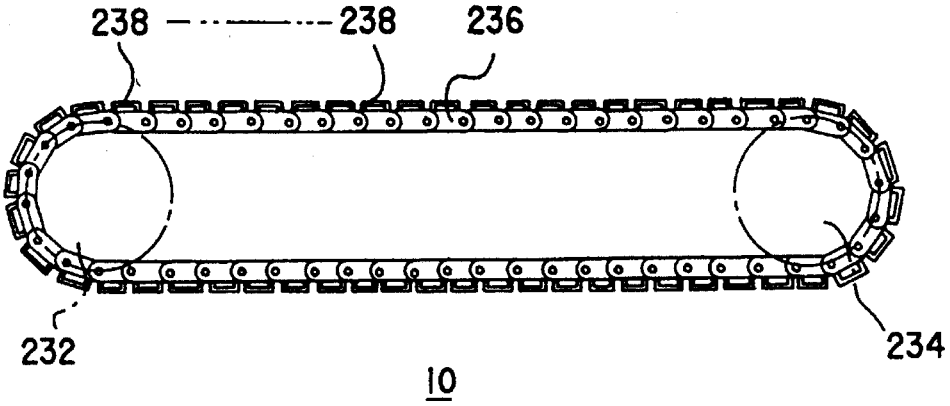
FIG. 12 is a cross section diagram to show the slat conveyer of the third preferred embodiment.
Figure 13:
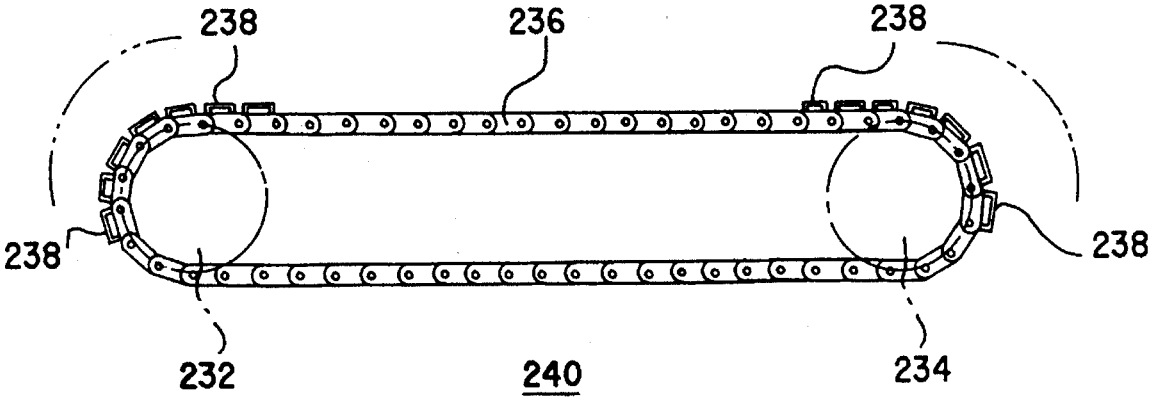
FIG. 13 is a cross section diagram to show the slat conveyer of another preferred embodiment.

FIG. 12 shows a slat conveyer 10 used in the crossfeeder unit 6. And FIG. 13 shows a slat conveyer 240 used in the crossfeeder unit 8. In FIGS. 12 and 13, 232 and 234 are drive rollers, 236 is a chain, and 238 is an individual slat. In the slat conveyer 10 in FIG. 12, slats 238 are arranged all around the chain 236. But in the slat conveyer 240 in FIG. 13, slats 238 are arranged only partially on the portions that face the tires, and the total range of slats 238 is made approximately ¼ of the total length of the chain 236, thereby the cost of slats 238 is reduced down to ¼ . In addition, the portion of the conveyer 240 where no slat is arranged is covered to prevent a person from falling into the opening.

FIGS. 14 through 18 show the actions of the slat conveyer 240 shown in FIG. 13. In FIGS. 14 through 18, 10 and 12 are the kind of slat conveyer where slats 238 are arranged all around the chain as shown in FIG. 12, while 240 and 241 are the kind of slat conveyer where slats 238 are arranged only partially on the portions that face tires as shown in FIG. 13. The conveyers 10 and 240 are for front wheels, while the conveyers 12 and 241 are for rear wheels.

Figure 14:
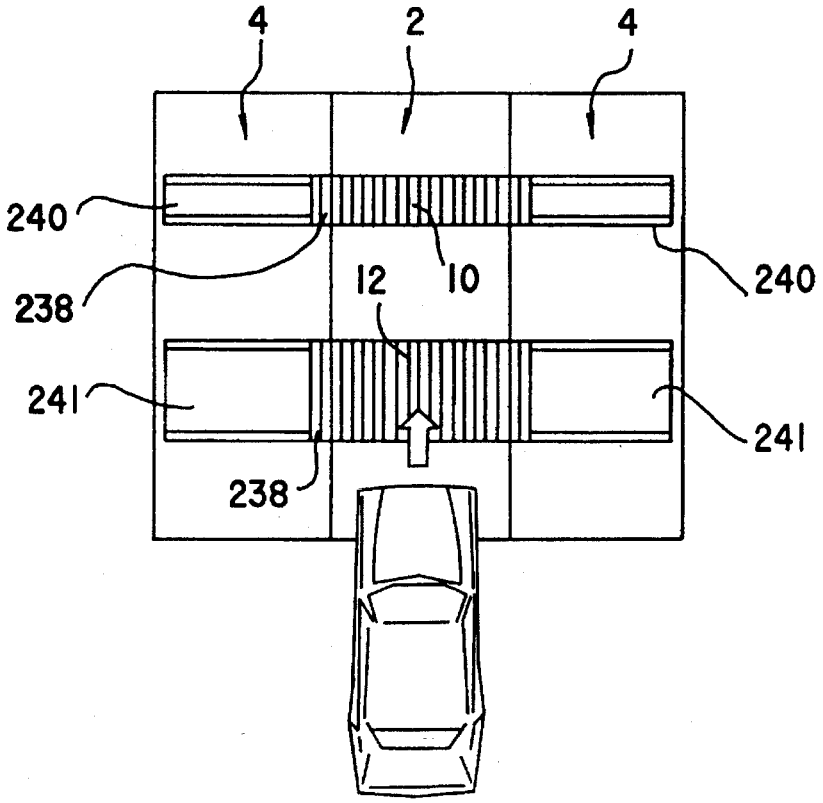
FIG. 14 is a floor plan to show a car arriving from self-running lane in another preferred embodiment.
Figure 15:
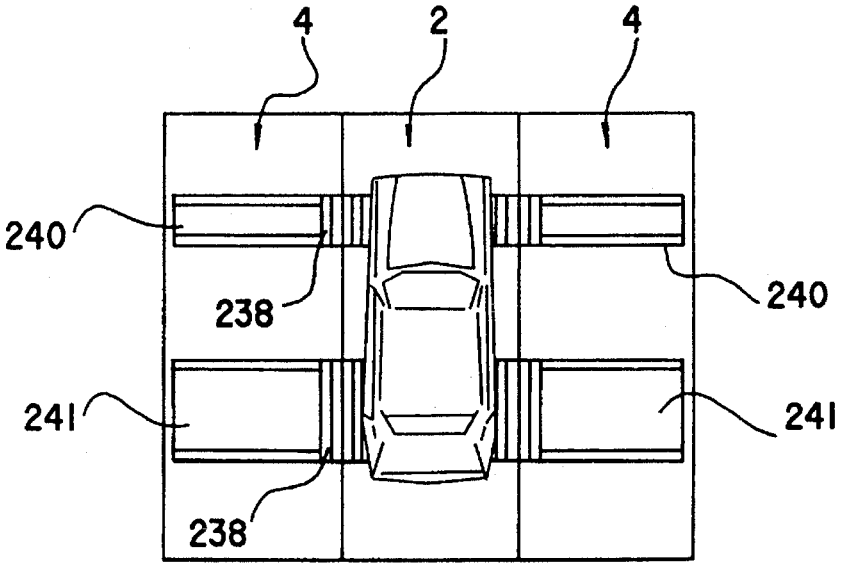
FIG. 15 is a floor plan to show a car stopping on self-running lane in another preferred embodiment.
Figure 18:
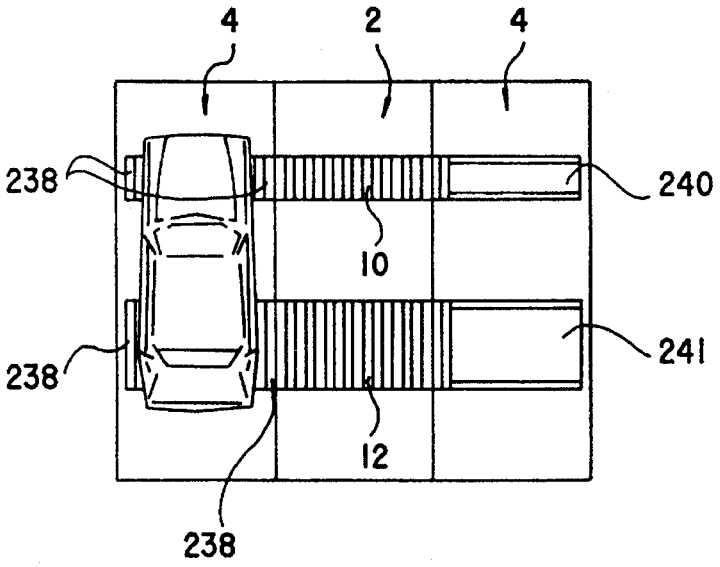
FIG. 18 is a floor plan to show the still status of a car in parking zone in another preferred embodiment.

Now suppose that a car is to be moved from the self-running lane 2 to the left parking zone in FIG. 14. The car that has ran on the self-running lane 2 stops at a position adjacent to the parking zone 4 (FIGS. 14 and 15) to be shifted to the parking zone 4. The slat conveyers 10 and 12 of the lane 2 is operated by the main motor 250, and the crossfeeding of the car is started. Even though the left tires of the car are on the slat conveyers 240 and 241 of the parking zone 4 (FIG. 16), the sub motor is not activated, and the conveyers 240 and 241 as well as the motor 252 are set idle. The main motor 250 is turned on until the car is shifted onto the slat conveyers 240 and 241, and after that, the car moves by inertia on the idle conveyers 240 and 241. For this reason, there is no fear of a person being injured even if sandwiched between the car and a wall. At the moment the car starts to go in the parking zone 4 as shown in FIG. 16, the slats 238 are always under the left tires of the car. The reason for this is to be explained later. When the car moves further to the left, the rightside tires are also on the slats 238, and the car is moved to the parking zone 4 with its tires of both sides on the slats 238.

These mechanisms are now explained with FIGS. 12 and 13. Shifting the car between the zone 4 and the lane 2 means turning the full length of the chain 236 by half. The slat conveyer 240 in FIG. 13 corresponds to a status where the tires of car is on the slats 238. Herein, if there is no car on the parking zone 4, the chain 236 turns by half, and the original left slats 238 goes around the right roller 234 to appear on its surface, while the original right slats 238 goes around the left roller 232 to hide under it. The slat conveyer 240 has only this still status and the still status shown in FIG. 13, and when it has completed moving a vehicle to the lane 2, slats 238 are on the right roller 234 and under the left roller 232. Then, if another vehicle is accepted, its let tires go onto the slat 238, and when the crossfeeder of the vehicle is completed, the conveyer returns to its status shown in FIG. 13. As a consequence, even if slats 238 are arranged partially on the slat conveyers 240 and 241 of the parking zone 4, tires will never be on other portions than those on the slats 238.

In the slat conveyer 10 of this embodiment, the slats 238 are arranged all around the chain 236, but slats 238 have only to be arranged, for example, on approximately half of the total length of the chain 238. For instance, slats 238 may be arranged only partially around the rollers 232 and 234. In the slat conveyer 10 shown in FIG. 12, suppose that slats 238 are not arranged on the its straight portions between the rollers 232 and 234. If a car is on the slat conveyer 10, when the car is moved outside, the chain 236 turns by half, and the position of the slats 238 will be just same as the original status. In this case, slats 238 are around the rollers 232 and 234, accordingly, from whichever direction a car is tried to be loaded, it is smoothly loaded on the slat conveyer since slats 238 are around the rollers 232 and 234.

Figure 19:
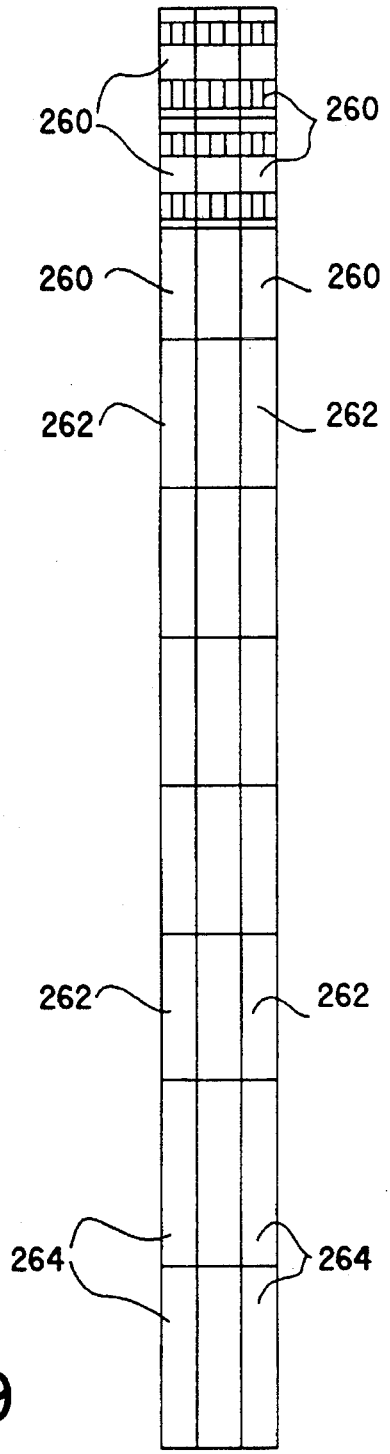
FIG. 19 is a floor plan to show the layout self-running lane and parking zone in another preferred embodiment.

In FIG. 1, all the zones 4 are arranged with a same length, however, the length of the zone 4 may be varied according to the type of light car, compact car, or large car. This example is shown in FIG. 19. The zone 260 for light cars may be set, for example, 3.5 m long, the zone 262 for compact cars may be 4.5 m, and the zone 264 for the large vehicles may be set 5.5 m long. In principle, a light car is to be stored in the zone 260 for light cars, while a compact car is to be stored in the zone 262 for compact cars however, when parking spaces are in short supply, such cars are temporarily parked in the zone 264 for large cars. In doing so, the parking capacity of a three-dimensional parking garage is increased, and accordingly its parking efficiency may be improved to a great extent.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

We claim:

1. A parking garage comprising:

a self-running lane for vehicles to move therethrough by means of a motor in each of the vehicles, said self-running lane having an entrance or entering the garage, said entrance being located near a first end of said self-running lane, and an exit for exiting the garage, said exit being located near a second end of said self-running lane;

a plurality of individual parking zones arranged on a first side and a second side of said self-running lane; and a plurality of first crossfeeder means for front wheels and a plurality of second crossfeeder means for rear wheels of the vehicles; at least one first crossfeeder means of said plurality of first crossfeeder means and at least one second crossfeeder means of said plurality of second crossfeeder means arranged at each of the individual parking zones and extending into the self-running lane, respectively, for moving the vehicle to and from one of said parking zones and said self-running lane; said parking garage further comprising an entrance gate arranged at a front of the entrance of said self-running lane;

safety sensors arranged at said entrance gate, said safety sensors for detecting the vehicle moving through said entrance gate;

alarm means arranged at each of said plurality of individual parking zones, said alarm means for signalling a presence of the vehicle moving from said each zones, and for signalling a presence of the vehicle entering said self-running lane from said entrance gate; and means to light at least one of said alarm means when the vehicle approaches from said entrance gate and when the vehicle is taken out by said crossfeeder means.

2. A parking garage as set forth in claim 1, wherein said at least one first crossfeeder means comprises a slat conveyer, and a surface of the slat conveyer is partially equipped with slats.

3. A parking garage as set forth in claim 1, wherein said plurality of individual parking zones have varying lengths.

4. A parking garage as set forth in claim 1, wherein said means to light at least one of said alarm means further comprises, means to flicker all of said alarm means at said individual zones when the vehicle approaches said entrance gate, and means to flicker only an alarm means at one of said parking zones from where the vehicle is about to exit when it is moved by said crossfeeder means.

5. A parking garage as set forth in claim 1, further comprising:

an entrance lift and an exit lift arranged along said self-running lane, and a first crossfeeder means for the front wheels and a second crossfeeder means for the rear wheels of the vehicle arranged at each of said entrance lift and said exit lift.

6. A parking garage as set forth in claim 1, further comprising:

individual parking zones of said plurality of individual parking zones arranged at one side of said self-running lane at least in part of said garage, and means to convey the vehicle among said individual parking zones of said plurality of individual parking zones by first and second crossfeeder means of said plurality of first and second crossfeeder means.

7. A parking garage as set forth in claim 1, wherein a portion of said at least one first crossfeeder means and said at least one second crossfeeder means extending into said self-running lane comprises a slat conveyer or a belt conveyer, and another portion of said at least one first crossfeeder means and said at least one second crossfeeder means of said individual parking zone comprises rollers.

8. A parking garage according to claim 1, further comprising:

safety sensors to detect the vehicle on said self-running lane; and means to prevent said at least one first and at least one second crossfeeder means from moving the vehicle transversely to said self-running lane when said safety sensors detect the vehicle existing within a predetermined distance from said individual parking zone.

9. A parking garage comprising:

a self-running lane for vehicles to move therethrough by means of a motor in each of the vehicles, said self-running lane having an entrance for entering the parking garage, said entrance being located near a first end of said self-running lane, and an exit for exiting the parking garage, said exit being located near a second end of said self-running lane;

a plurality of individual parking zones arranged on a first side and a second side of said self-running lane; and a plurality of first crossfeeder means for front wheels and a plurality of second crossfeeder means for rear wheels of the vehicles; at least one first crossfeeder means of said plurality of first crossfeeder means and at least one second crossfeeder means of said plurality of second crossfeeder means arranged at each of the individual parking zones and extending into the self-running lane, respectively, said at least one first and said at least one second crossfeeder means being independently movable for moving the vehicle to and from one of said parking zones and said self-running lane;

wherein each of said individual parking zones is equipped with a control unit including a manually operable entrance switch and a manually operable exit switch to control said first and second crossfeeder means.

10. A parking garage according to claim 9, further comprising:

safety sensors to detect the vehicle on said self-running lane; and means to prevent said at least one first and at least one second crossfeeder means from moving the vehicle transversely to said self-running lane when said safety sensors detect the vehicle existing within a predetermined distance from said individual parking zone.

11. A parking garage as set forth in claim 9, wherein said at least one first crossfeeder means and said at least one second crossfeeder means are equipped with a main motor for driving self-running portions of said at least one first crossfeeder means and said at least one second crossfeeder means in the self-running lane, and a sub motor for driving parking portions of said at least one first crossfeeder means and said at least one second crossfeeder means in said each of the individual parking zones, said main motor having a higher output power than an output power of the sub motor, said control unit controlling both said main motor and said sub motor.

12. A parking garage as set forth in claim 11, wherein said control unit controls said main motor to move the vehicle from said self-running portions to said parking portions, and controls said main motor and said sub motor to move the vehicle from said parking portions to said self-running portions.

13. A parking garage as set forth in claim 9, wherein said at least one first crossfeeder means comprises a slat conveyer, and a surface of the slat conveyer is partially equipped with slats.

14. A parking garage as set forth in claim 9, wherein said plurality of individual parking zones have varying lengths.

15. A parking garage as set forth in claim 9, further comprising:

an entrance lift and an exit lift arranged along said self-running lane, and a first crossfeeder means for the front wheels and a second crossfeeder means for the rear wheels of the vehicle arranged at each of said entrance lift and said exit lift.

16. A parking garage as set forth in claim 9, further comprising:

individual parking zones of said plurality of individual parking zones arranged at one side of said self-running lane at least in part of said garage, and means to convey the vehicle among said individual parking zones of said plurality of individual parking zones by first and second crossfeeder means of said plurality of first and second crossfeeder means.

17. A parking garage as set forth in claim 9, wherein a portion of said at least one first crossfeeder means and said at least one second crossfeeder means extending into said self-running lane comprises a slat conveyer or a belt conveyer, and another portion of said at least one first crossfeeder means and said at least one second crossfeeder means of said individual parking zone comprises rollers.

* * * * *